United States Patent [19]

Keim et al.

[11] Patent Number: 4,936,357

[45] Date of Patent: Jun. 26, 1990

[54] HOOK CONTROL DEVICE FOR AN OPEN SHED JACQUARD MACHINE

[75] Inventors: Walter Keim, Senden; Kurt Jhle, Holzheim, both of Fed. Rep. of Germany

[73] Assignee: Grosse Webereimaschinen GmbH, Neu-Ulm/Burlafingen, Fed. Rep. of Germany

[21] Appl. No.: 185,094

[22] Filed: Apr. 22, 1988

[30] Foreign Application Priority Data

Apr. 24, 1987 [DE] Fed. Rep. of Germany ..... 3713832

[51] Int. Cl.[5] ..... D03C 13/00; D03C 3/00; D03C 3/06; D03C 3/20

[52] U.S. Cl. ..... 139/455; 139/59; 139/65

[58] Field of Search ..... 139/55.1, 59, 64, 65, 139/68, 455, 317, 319

[56] References Cited

U.S. PATENT DOCUMENTS

| | | | |
|---|---|---|---|
| 4,515,186 | 5/1985 | Durville et al. | 139/455 |
| 4,593,723 | 6/1986 | Griffith | 139/455 |
| 4,667,704 | 5/1987 | Griffith | 139/65 |
| 4,702,286 | 10/1987 | Palau et al. | 139/59 |
| 4,739,806 | 4/1988 | Palau et al. | 139/59 |

FOREIGN PATENT DOCUMENTS

| | | | |
|---|---|---|---|
| 0108700 | 5/1984 | European Pat. Off. . | |
| 0188074 | 7/1986 | European Pat. Off. . | |
| 0219437 | 4/1987 | European Pat. Off. . | |
| 2214073 | 11/1987 | European Pat. Off. . | |
| 1710185 | 7/1971 | Fed. Rep. of Germany . | |
| 2204815 | 2/1973 | Fed. Rep. of Germany . | |
| 1535270 | 9/1979 | Fed. Rep. of Germany . | |
| 3233547 | 3/1984 | Fed. Rep. of Germany . | |
| 609113 | 4/1958 | Italy | 139/65 |
| 2047755 | 3/1980 | United Kingdom . | |

*Primary Examiner*—Andrew M. Falik
*Attorney, Agent, or Firm*—Scully, Scott, Murphy & Presser

[57] ABSTRACT

An open shed Jacquard machine in which two hooks are connected at one end over a common pulley and can be coupled with knives when moving in opposite directions. A common electromagnet arranged between the hooks serves for control according to a pattern in a defined shed position. The electromagnet is mounted in a housing to tilt or see-saw about an axis. In the reading position each hook is mechanically moved to approach the pole of the electromagnet, in particular to abut against it.

13 Claims, 3 Drawing Sheets

V
36
32
34
37
17
42
31
45
19
41
50
48
49
20
40
15
30
38
28
46
9
16
33
35
43
39
21
52
51
22
29
47
10

FIG. 6
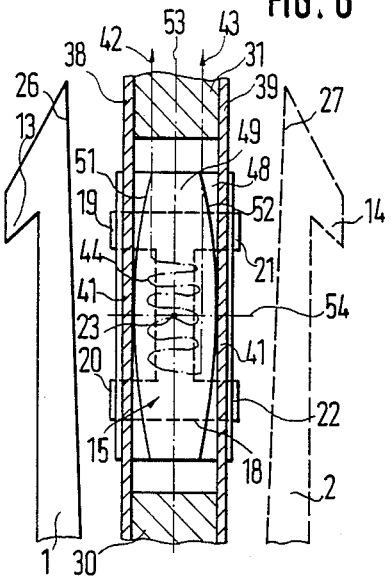
FIG. 7
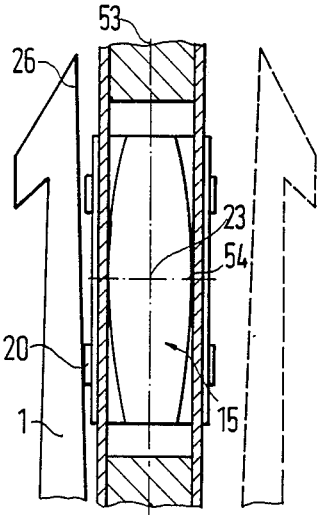
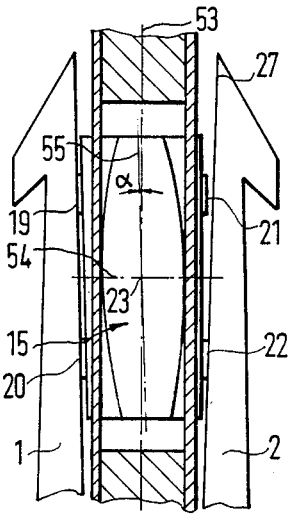
FIG. 8
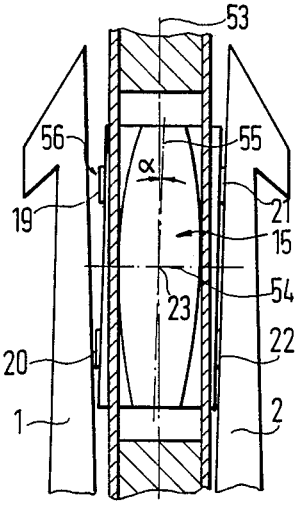
FIG. 9

HOOK CONTROL DEVICE FOR AN OPEN SHED JACQUARD MACHINE

TECHNICAL FIELD OF THE INVENTION

The invention relates to a hook control device for an open shed Jacquard machine.

BACKGROUND OF THE INVENTION AND PRIOR ART

In an open shed Jacquard machine of this kind two hooks are joined at the bottom end over a common pulley, and the hooks, depending on the control means used, can be coupled usually with two lifting knives which constantly move in opposite directions, whereby the pulley and therefore the warp thread connected thereto, are given a controlled lifting movement. Open shed Jacquard machines of this kind have become less important with the development of Jacquard machines with single hooks which do not require a pulley system and can be controlled by means of punched cards.

The inherent advantages of the open shed Jacquard machine in comparison to the other Jacquard machines again become significant if electronic data processing can be used to control Jacquard machines. This is the case if electrically controllable systems such as magnets can be used for the control. An early attempt is described in DE-OS 22 04 815 in which for each hook a hook element is provided as an essential intermediate member which is held resiliently in an arresting position and which, by energizing a respective electromagnet, is moved out of the arresting position and pulled across the air gap towards the electromagnet. This hook control device is obviously very complicated and therefore susceptible to trouble and in addition requires a considerable amount of space.

A further development is described in GB-OS 20 47 755. In this known control device, on which the present invention is based, a single magnet is arranged between the two hooks of a pair of hooks whereby arresting only occurs in the upper shed position when the magnet is energized in this position and attracts the hook across the substantial air gap. In an alternative embodiment, for each hook a hook element is attached to the carrier of the single magnet as an intermediate member, and the nebs of these hook elements must be moved out of the path of movement of the hook when the magnet is energized and moved across a likewise substantial air gap to abut against the magnet yoke.

Owing to the fact that when the magnet is energized the movable elements (hook or intermediate member) must be moved over a substantial air gap, which depends on the design and cannot be defined exactly, the problem is not only that the energy requirements are considerable. In addition, considerable efforts are needed for shielding neighbouring magnets, and there is also the danger that when de-energizing the magnet a controlled hook or a controlled intermediate member remains adhering to the magnet or its pole, resulting in defective control so that reliable operation is not ensured. In addition the known system has the disadvantage that it can only operate exclusively in the upper shed position whereby it is only possible to hook and unhook the elements under high tension which results in great stresses and great wear. This disadvantage is particularly serious when an adhering hook is suddenly released from the electromagnet and moves at great speed through the Jacquard machine until it collides with great force with a knife or the bottom board. This can easily lead to damage and the hook can even be destroyed. Finally, many structural elements are necessary, which is an obstacle to a compact arrangement which is simple to assemble.

OBJECT OF THE INVENTION

On this basis, it is the object of the invention to improve a hook control device of the kind mentioned herein so that safe and reliable operation is possible with a simple construction.

SUMMARY OF THE INVENTION

The object of the present invention resides in the provision of a novel and improved hook device for an open shed Jacquard machine with two hooks which are joined at one end over a common pulley, and which can be alternately moved between an upper shed position and a lower shed position.

The basis of a fundamental embodiment of the invention is that it is not sufficient to use an electrically controllable control of the hooks instead of a mechanical one: in addition action must also be taken in the region of the hooks. By mechanically deflecting the hooks and thus bringing them into a defined position relative to the magnet, the energy requirements can already be reduced considerably to what is absolutely essential. The circumstances are particularly expedient when, in the defined shed position, the hook is brought into alignment with the magnet or its pole mechanically. It is then no longer necessary to supply enough energy to overcome an air gap: on the contrary, it is sufficient to supply enough energy to keep the hook adherent. The better the hook is placed on the magnet pole mechanically, the less is the expenditure of energy needed Thus again, the danger that a hook remains adherent when de-energizing and that it is not lifted off by the restoring force is extremely small, as the restoring force of the spring can be made adequately high, taking only the force of adhesion into consideration. Moreover, assembly thereof is very simple and a high packing density is possible.

A further important advantage can be seen in that the control, or reading-in, can take place in the upper shed position as well as in the lower shed position, in which the tension exerted on the hook is relatively low and there is therefore little wear of the components.

According to another basic embodiment the magnet itself can be made tiltable. Through this feature there is ensured that even if a hook or an intermediate member should adhere, then at the latest when the other hook of the same hook pair or the other intermediate member of the pair of intermediate members is deflected relative to the magnet so that it clings to the magnet and the magnet is thereby tilted so that an air gap is inevitably produced at the first adhering hook or the first intermediate member, the spring tension, possibly even the intrinsic elasticity, is sufficient to release the hook or the intermediate member from the magnet.

BRIEF DESCRIPTION OF THE DRAWINGS

The invention will be described with reference to the exemplary embodiments shown in the drawings, in which FIGS. 6 to 9 show diagrammatically the mode of operation of a tiltable magnet.

DETAILED DESCRIPTION OF PREFERRED EMBODIMENTS OF THE INVENTION

Figure 1:
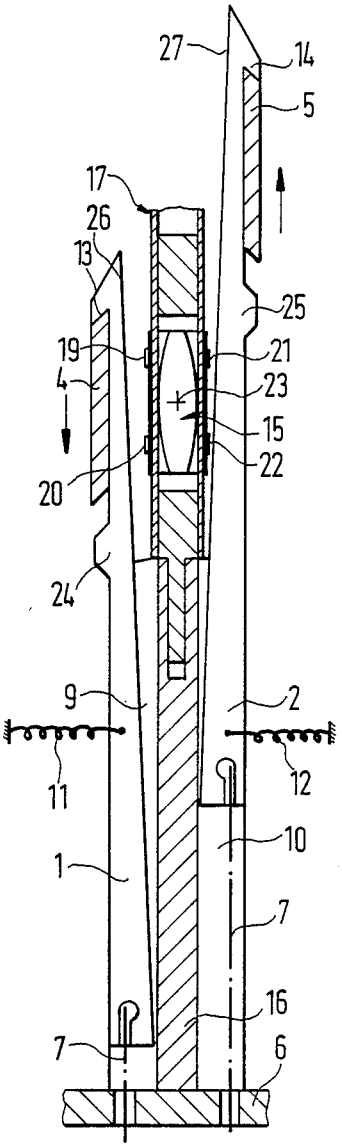
FIGS. 1 to 3 show diagrammatically an exemplary embodiment of a hook control device according to the invention as well as its mode of operation.
Figure 2:
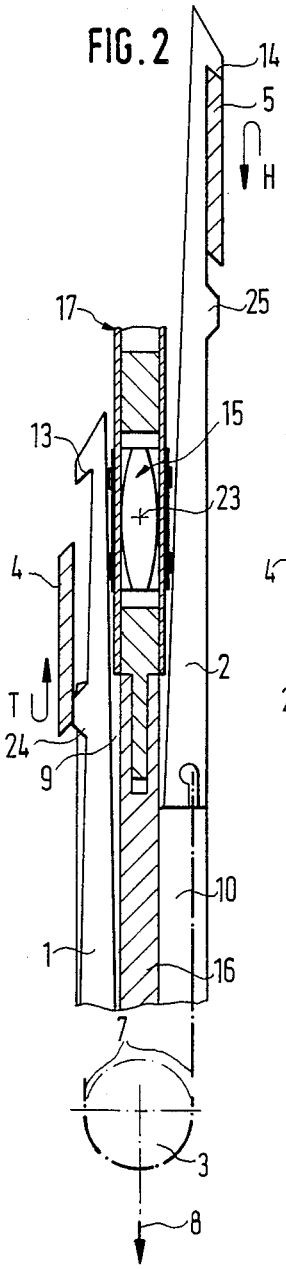

According .o FIG. 1 two hooks 1 and 2 are connected with one another at the lower end over a common pulley 3 (FIG. 2). Each hook 1, 2 has a lifting knife 4 and 5 respectively associated with it which can be moved counter to one another between an upper shed position H and a lower shed position T as is shown diagrammatically by the arrows. According to FIG. 2 the lifting knife 5 is in the upper shed position H while the lifting knife 4 is in the lower shed position T. In the lower shed position T the lower end of the respective hook 1 or 2 rests on a bottom board 6 shown in FIG. 1, while the cord 7 which runs over the pulley 3 and connects the hooks passes through the bottom board 6. Connected to the pulley 3 in the usual manner is a heald 8 which is subjected to a controlled lifting movement due to the raising and lowering movement of the pulley 3. The hooks 1, 2 are guided in guides 9 and 10 respectively so that they move between the upper shed position H and lower shed position T in a straight line, and by means of a spring arrangement 11, 12 a restoring force can act on the respective hooks 1, 2 towards the associated lifting knives 4, 5, thus ensuring that a neb 13, 14 located at the upper end of each hook 1, 2 can come into contact with the associated lifting knife 4 or 5, even if, as is indicated in FIG. 2, when the hook 1 rests on the bottom board 6 the associated lifting knife 4 still moves down a little further into the lower shed position T, whereby the engagement between the lifting knife 4 and the neb 13 of the hook 1 is released.

In Jacquard machines with movable lifting knives it is possible, when the hooks are in one position, to break and remake the engagement between a hook and the lifting knife associated with it as desired in order to create a desired Jacquard pattern. Conventionally needle mechanisms are used which, in a position in which the hook and the lifting knife associated therewith are not in engagement, move the hook out of the path of movement of the lifting knife so that on its next movement the lifting knife passes the hook controlled in this way and does not take it along therewith. This process is called reading-in a pattern, or pattern control. Reading-in need not be done by mechanical means, but can alternatively be done by electrical means, as is usually the case in modern machines, through an electromagnet in one of its energized states serving to deflect the hook and to hold it in the deflected state (controlled state) whereas in the other energized state no deflection occurs and the lifting knife can take the hook therewith. It should also be noted that it essentially only comes down to subjecting the pulley to a movement and at the same time moving the hooks relative to a control device so that control according to the pattern is possible.

In the open shed Jacquard machine of the type concerned, a common electromagnet 15 is provided between the two hooks 1 and 2 joined to one another over the pulley 3. The electromagnet 15 is in a housing 17 mounted on a carrier 16 between the two hooks 1 and 2. As will be explained in more detail below, the electromagnet 15 comprises an essentially I-shaped yoke 18 of which two poles 19, 20 and 21, 22 respectively each face one of the hooks 1, 2 and extend towards the outside of the housing 17. The electromagnet 15 is arranged so as to tilt about an axis 23 in the housing 17 which is parallel to the reach of the lifting knives 4, 5 and at right angles to the direction of movement of the hooks 1, 2. A specific exemplary embodiment in which this can be done is explained in more detail below.

Each hook 1, 2 has in addition a nose 24, 25 respectively which protrudes from the respective hook 1, 2 in the same direction as the corresponding neb 13, 14 of the respective hook 1, 2. In the exemplary embodiment the noses 24, 25 are arranged so that when the hook 1, 2 is supported on the bottom board 6 and the neb 13 and 14 is released by the further downward of the lifting knife 4 and 5 the associated lifting knife 4, 5 runs against the respective nose 24, 25 and, as shown in FIG. 2, the hooks 1, 2 come into abutment against the poles 19, 20 or 21, 22 respectively of the electromagnet 15 against the restoring force due to the respective spring arrangement 11, 12. This process is called (mechanical) offering. Owing to the fact that the electromagnet 15 can be tilted about the axis 23, it is ensured that the hook 1 or 2 is always in abutment with the two associated poles 19 and 20 or 21 and 22. At the same time it is advantageous to incline the side 26, 27 of the respective hook 1, 2 facing the poles 19, 20 or 21, 22 in the direction of movement of the hooks 1, 2.

Figure 3:
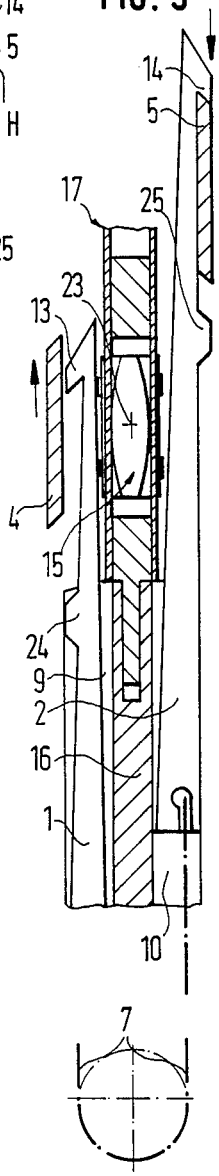

If the electromagnet 15 is energized (controlled) in the case of this mechanical offering, the corresponding hook (in FIG. 3 the hook 1) adheres to the electromagnet 15 and the lifting knife 4 passes the neb 13 in the course of the lifting movement without taking the hook 1 therewith. The hook 1 thus stays in the lower shed position T. If, on the other hand, the electromagnet 15 is not energized the associated hook 1 or 2 returns, due to the force of the spring arrangement 11 or 12, to the position in which the associated lifting knife 4 or 5 can come into engagement with the neb 13 or 15 as soon as the respective lifting knife 4 or 5 has left the lower shed position T in which, due to abutment with the nose 24 or 25, it offered the hook 1, 2 to the electromagnet 15. The man skilled in the art will have no difficulty either in making the arrangement such that the hooks 1, 2 are offered to the electromagnet 15 in the upper shed position H if so desired. In such instance, the electromagnet 15 would be located proximate the region of the upper shed H rather than towards the lower shed T as shown in FIG. 1 to 3. For the remainder, the apparatus and functioning thereof would be identical in all respects. However, it should be noted that when reading-in or controlling in the upper shed position not only is an arresting device such as an arresting knife required, but moreover hooking and unhooking the hooks at the lifting knife occurs under high tension which results in great demands and wear. For this reason it is advantageous to perform the mechanical offering, and thus the reading-in, in the lower shed position T in which the hooks are released by contact with the bottom board.

It is of considerable importance that the hooks are offered to the electromagnet mechanically, as the hook is thereby already mechanically arranged at a defined distance from the poles, and in particular in abutment with the poles without any air gap at all. Particularly in the latter case, only that amount of energy required to hold the hook that is already abutting need be used when controlling. This force of adhesion is clearly weaker than that which is necessary to overcome the air gap, which again depends on the size of the air gap. As a result, the power requirements per electromagnet are considerably reduced, whereby possible disadvantageous effects on adjacent electromagnets are safely avoided. In addition this allows the size of the electromagnets to be small, which is of importance for constructional reasons in respect of the complete Jacquard machine. Moreover, only a small amount of heat is developed, which is why cooling measures are only necessary to a small extent if at all. Finally, the control electronics can also be small in size and can therefore be preferably arranged near the electromagnets.

As a further advantage the sections of the electromagnets 15 which project outwardly out from the housing 17 facing the hooks 1, 2, or rather their rear sides 26 and 27, namely the surfaces of the poles 19 to 22, can be treated chemically or galvanically, preferably hard chromium plated. By this means wear is further reduced and the adhesion effect is also improved.

Figures 4, 5:
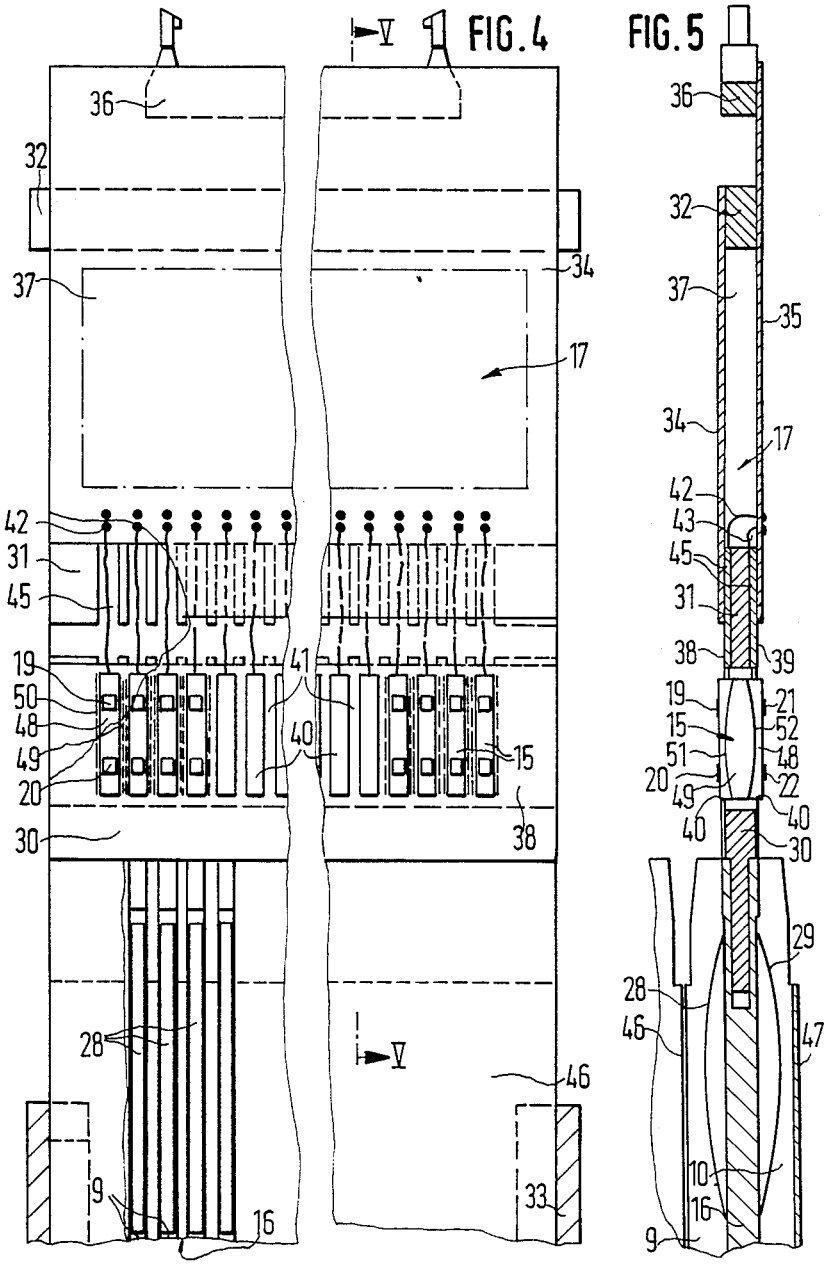
FIGS. 4 and 5 show the arrangement and association of several magnets.

In FIGS. 4 and 5 an embodiment is shown in which the control device according to the application is suitable for modular design and is therefore particularly easy to assemble (and is easy to service).

In FIGS. 4 and 5 the hooks and lifting knives are not shown. The restoring force exerted by the spring devices 11 and 12 shown diagrammatically in FIG. 1 is produced in the embodiment according to FIGS. 4 and 5 by leaf springs 28, 29 inserted in the guides 9 and 10, a guide and a corresponding leaf spring being provided for each hook. The electromagnets 15 provided for each pair of hooks are also tightly packed in a common housing 17. The housing 17 has frame parts 30, 31, 32 which run substantially parallel to the direction of reach of the lifting knives 4, 5 (not shown in FIG. 4 and FIG. 5) and which can be supported on the carrier 16 as well as in the frame 33 of the machine. Two cover plates 34, 35 are also provided of which one supports the pin part 36 of a plug connection. Formed between the cover plates 34, 35 and the frame parts 31, 32 is a hollow space 37 in which the essential parts of the electric and electronic circuit for controlling the electromagnets 15 can be placed, so that only reading control signals, which can even be coded, need to be supplied by way of the plug connection. As is indicated diagrammatically, one of the cover plates can itself be formed as a printed circuit: in FIG. 5 this is the cover plate 35. In addition the housing 17 has a further two cover plates 38 and 39 between the frame parts 31 and 30 which define a hollow space in which the individual electromagnets 15 are arranged next to one another. The cover plates 38 and 39 can be formed integral with the cover plates 34 and 35. Substantially rectangular openings 40 between which ribs 41 remainand which correspond to the position of the electromagnets 15 are provided in the cover plates 38 and 39. The dimensions of the openings 40 and the electromagnets 15 are such that only the sections carrying the poles can pass through the openings 40. The control lines 42, 43 for the electromagnets 15 or their spools 44 are suitably inserted in grooves 45 in the frame part 31 and connected to the circuit arrangement connected in the hollow space 37 or connected to the cover plate 35 as shown in FIG. 5, when the latter is formed as a printed circuit.

It should be mentioned that obviously the openings 40 must be formed so that the desired tilting or see-sawing movement of the electromagnets 15 is possible.

In addition it is shown that the guides 9 and 10 can also be covered by cover plates 46, 47 whereby separation between neighboring modules is ensured and assembly is simplified. Moreover neighbouring modules can be displaced with regard to the position of the hooks and therefore the guides. As indicated in FIG. 4, the cover plates 46 can extend nearly to the region of the frame parts 30, or alternatively they can be shorter, as shown in FIG. 5. In order to insert the leaf springs 28, 29, additional corresponding grooves or recesses can be provided in the guides 9, 10 as indicated.

From the above it appears that it is possible to assemble and test a module of this kind completely outside the machine frame and only afterwards insert it in the machine frame. It follows that it is possible to replace a module in a simple manner. In particular, when the number of electromagnets per module and the divisions have been standardized, the customer service technician can make an easy exchange without the storage of a large number of different modules being necessary.

The mode of operation will now be described in more detail with reference to FIGS. 6 to 9.

FIG. 6 shows, again on an enlarged scale, the structure and the arrangement of the electromagnet 15 within the housing 17 as well as the position of the poles 19 to 22 relative to the hooks 1 and 2, the latter being indicated by broken lines in FIGS. 6 and 7 as it is in fact in a different shed position.

FIG. 6 shows the I-yoke 18 of the electromagnet with the poles 19, 20 and 21, 22 leading outwards, and also the spools 44, of which the control lines 42, 43 are leading outwards. The electromagnet 15 has thickened sections 49, 50 (cf. FIG. 4) on both sides of the section 48 having the yoke 18 (facing in the direction of the axis 23) which are located within the housing 17 and ensure support therein. For the swing required about the axis 23, spherical surfaces 51 and 52 are provided on these thickened sections 49 and 50, each facing the respective hook 1, 2, which is supported in line contact on the respective inner side of the rib 41 of the respective cover plate 38, 39. For the purpose of explanation, shown is a further axis 53 extending through the axis 23, parallel to the direction of movement of the hooks 1, 2, and an axis 54 at right angles to this axis and likewise extending through the axis 23 at the level of which at a standstill (FIG. 6) the spherical abutting surfaces 51, 52 are in line contact with the inner sides of the cover plates 38, 39 respectively.

FIG. 7 now shows the beginning of the mechanical offering. The rear side 26 of the hook 1 facing the poles 19, 20 at first comes into contact with the yoke 20 which is located at the bottom in the drawing. As the offering proceeds, the hook 1 tilts the electromagnet 15 about the axis 23 until the rear side 26 also comes into abutment with the other pole 19 (FIG. 8, left half). As a result, the corresponding axis 55 of the electromagnet 15, which in FIG. 7 still coincides with the axis 53, has turned about an angle $\alpha$, albeit a small one; and continues to be at right angles to the axis 54, as this connects the line contact points of the spherical contact surfaces 51, 52.

Generally, it is assumed that the restoring force of the spring device 11 (or the leaf spring 28) is sufficient to release the hook 1 from the poles when the electromagnet 15 is de-energized, so that the electromagnet 15 then returns to the position shown in FIG. 6 (essentially due to gravity), particularly considering that the energy supplied to the electromagnet 15 need only be sufficient to let the hook 1 adhere to the poles 19, 20. Overcoming an air gap is no longer necessary.

However, should the hook 1 still adhere despite this, this condition is automatically obviated on the following mechanical offering of the other hook 2. At the start of this offering, and even a little earlier than in FIG. 7, the rear side 27 of the hook 2 touches the magnet 15 and also comes into abutment with the lower pole 22 (FIG. 8) earlier and automatically tilts the electromagnet 15 into the position shown in FIG. 9, and it therefore tilts the axis 55 of the electromagnet 15 in the opposite direction through substantially the same angle with the value $\alpha$ relative to the axis 53. The hook 1 is hereby necessarily lifted off the pole 19 and therefore also 20, so that an air gap 56 is also necessarily formed, whereby the hook 1 is released from the electromagnet 15 at all events. This occurs even if the electromagnet should be energized for adherence, i.e. to control the hook. Suitably, however, the electromagnet 15 is only controlled for energizing when the mechanical offering process is completed.

In the exemplary embodiments an arrangement is shown in which the axis 23 runs essentially central to the electromagnet 15. However, this tilt axis 23 can also be arranged in another position. What is important is that the electromagnet 15 can carry out a tilting movement so that on the mechanical offering the hook tilts the electromagnet 15 so that it automatically comes to a defined position relative to, preferably abutting against, the two facing poles of the yoke of the electromagnet 15. The only other important thing is that the respective hook is mechanically offered in the reading position.

It is found, however, that a control device which "only" comprises one magnet which can be tilted already has very important advantages, because when a hook is adherent the magnet remains deflected. When the other hook is now attracted it also touches the magnet for the purpose of abutting against at least one associated pole and thereby tilts the magnet at least to the middle neutral position whereby the first hook is acted on mechanically, in the sense of being lifted off, whereby, at the latest when the magnet is de-energized, both hooks are released by the restoring force. It follows that the magnet that can be tilted can also be used in control devices in which an intermediate member is moved in order to arrest or not to arrest a hook in a defined shed position according to a pattern. This embodiment results if FIGS. 6 to FIG. 9 are looked at in reverse and the hooks shown there are replaced by intermediate members having hook elements, in which case these intermediate members are fixed to a stationary carrier. The hooks which are also present are moved relative to the hook elements for the purpose of controlled engagement (arresting) with the hook elements.

What is claimed is:

1. A hook control device for open shed Jacquard machines having a pair of hooks joined at one end over a common pulley, said hooks being selectively movable between an upper shed position and a lower shed position; lifting knives associated with each respective hook with which the hooks are selectively coupled in a defined shed position for effectuating controlled arresting of said hooks, each said hook being located opposite an energizable magnet which is arranged in a space between the paths of movement of said two hooks, in the energized condition said magnet causing the respective hook arranged opposite thereto to be retained thereagainst to enable said knife associated with the hook to be shifted from a non-controlled condition into a controlled condition preventing movement of said hook between said upper shed position and said lower shed position, and in the deenergized condition of the magnet said hook is released from restraint therewith such that the hook is movable between said upper shed position and said lower shed position, spring tension means for moving said hook out of the controlled position and into the uncontrolled position when said magnet is deenergized; and means for mechanically moving each said hook opposite the action of the spring tension means towards the magnet.

2. A hook control device according to claim 1, wherein said magnet is shaped such that in the controlled condition of a respective one of said hooks, said hook is in a defined position relative to the poles of the magnet to enable said magnet to retain said hook thereagainst.

3. A hook control device according to claim 1; wherein said spring tension means comprises a leaf spring for exerting tension between each said hook and carrier for said magnet.

4. A hook control device according to claim 1, wherein for effectuating the mechanical movement into the defined position the hooks each have a nose which is arranged so that in the controlled condition of a respective hook the nose of said hooks abuts against an associated knife so as to automatically cause a mechanical deflecting movement of the hook into a position relative to the magnet enabling said magnet to retain said hook in contact therewith.

5. A hook control device according to claim 1, wherein the side of the hook facing the magnet is inclined relative to the direction of movement of the hook by an amount correlated with an angular tilting movement of the magnet.

6. A hook control device according to claim 1, wherein the surfaces of the magnet against which the hooks abut are chemically or galvanically treated.

7. A hook control device according to claim 6, wherein the surfaces of the magnet against which the hooks abut are hard-chromium plated.

8. A hook control device according to claim 1, wherein a plurality of said magnets are arranged in a common housing for controlling a plurality of pairs of said hooks which are coupled with the same pair of knives.

9. A hook control device according to claim 8, wherein electrical circuits for controlling the state of energization for the magnets are at least partially contained in the housing.

10. A hook control device for open shed Jacquard machines having two hooks joined at one end over a common pulley, said hooks being selectively movable between an upper shed position and a lower shed position; lifting knives with which the hooks are selectively coupled in a defined shed position for the effectuating of a controlled arresting of the hooks associated therewith, each said hook being positionable in an arrested position opposite an energizable magnet which is arranged to be tiltably supported in a space between the paths of movement of the two hooks; said magnet in the energized state retaining the respective oppositely arranged hook to enable the knife associated with said hook to move said hook from an uncontrolled position into a controlled position preventing further movement of said hook, whereas in the deenergized state of said magnet the respective hook is again movable, spring tension means for moving the respective hook out of the controlled position and back into the uncontrolled position upon deenergizing of said magnet, and said magnet being arranged so as to tilt about an axis at right angles to the direction of movement of the hooks and parallel to the reach of the knives such that upon contact of one of the hooks with the magnet, said hook tilts the magnet.

11. A hook control device according to claim 10, wherein said tilting movement is effected about an axis which extends substantially centrally with regard to the magnet.

12. A hook control device according to claim 11, wherein the poles of the magnet protrude outwardly through openings formed in a stationary housing, and the magnet is fixed in the housing so as to tilt about said axis.

13. A hook control device according to claim 12, wherein the magnet has spherical contact surfaces on both sides of the poles facing each hook which are in the line contact with an inner surface of the housing on both sides of openings formed therein.

* * * * *